US006672826B2

(12) United States Patent
LeDuc

(10) Patent No.: US 6,672,826 B2
(45) Date of Patent: Jan. 6, 2004

(54) COMPRESSOR SURGE CONTROL APPARATUS

(75) Inventor: Marc S. LeDuc, Santa Maria, CA (US)

(73) Assignee: Mafi-Trench Corporation, Santa Maria, CA (US)

( * ) Notice: Subject to any disclaimer, the term of this patent is extended or adjusted under 35 U.S.C. 154(b) by 91 days.

(21) Appl. No.: 10/117,251

(22) Filed: Apr. 5, 2002

(65) Prior Publication Data

US 2003/0190229 A1 Oct. 9, 2003

(51) Int. Cl.[7] ..... F04D 27/02

(52) U.S. Cl. ..... 415/58.4; 415/159; 417/300

(58) Field of Search ..... 415/58.4, 58.3, 415/58.2, 159, 157, 26, 36, 44, 49, 165–167; 417/300, 307, 309

(56) References Cited

U.S. PATENT DOCUMENTS 4,213,735 A * 7/1980 Grennan ..... 415/21
4,764,088 A * 8/1988 Kapich ..... 415/150
5,669,756 A * 9/1997 Brasz et al. ..... 415/58.2
5,807,071 A * 9/1998 Brasz et al. ..... 415/150
6,036,432 A * 3/2000 Sishtla et al. ..... 415/26
6,273,671 B1 * 8/2001 Ress, Jr. ..... 415/1

* cited by examiner

*Primary Examiner*—Edward K. Look
*Assistant Examiner*—J. M. McAleenan
(74) *Attorney, Agent, or Firm*—William W. Haefliger

(57) ABSTRACT

Apparatus for compressing fluid flow and for controlling said flow, comprising in combination, a casing having an interior, an impeller rotating within said interior between a fluid supply zone and pressurized fluid discharge zone, fluid flow control members at least one of which is shiftable in the casing interior relative to the other to control fluid back-flow from said discharge zone to said supply zone via through ports in each of said members, and an actuator operatively connected to said one member to shift said one member relative to the other to control the degree of registration of said flow ports in said members, in response to changes in the supply of fluid to said supply zone.

16 Claims, 6 Drawing Sheets

48
46
7
43a
43
22
43b
52
7
51
40
51
14
52

22
52
43
46
48
48

14
51

COMPRESSOR SURGE CONTROL APPARATUS

BACKGROUND OF THE INVENTION

This invention relates generally to surge control in compressor systems, and more particularly to a simple reliable compressor with built-in surge control.

Centrifugal process compressors are subject to flow instability phenomenon, broadly labeled "surge", when the available flow through the compressor impeller drops below a minimum threshold value which is dependent upon various parameters of the individual compressor design.

Continuous operation of a compressor under surge conditions is undesirable as it can damage the compressor. To prevent operation in surge a typical compressor installation includes a surge control or "false load" loop of piping, routed from the compressor discharge pipeline, through a control valve back to the compressor inlet piping. During normal operation there is little or no flow through the recirculation pipe loop. When process measurements signal that compressor inlet flow is dropping to levels approaching the onset of surge, a process controller causes the recalculation valve to open sufficiently to allow some of the compressor discharge flow to be reintroduced back at the compressor inlet, thus increasing the flow through the compressor and preventing surge. The design and installation of the surge control-piping loop is a cost consideration at compressor plant sites. Typically this system is not supplied by the compressor manufacturer and thus also requires communication between the plant engineering contractor and the compressor manufacturer to coordinate the operational and space claim requirements of the anti-surge system.

There is need for an improved apparatus that eliminates the requirement for a surge control piping system as described above and which generally allows a reduction in the recirculation mass flow required to prevent surge. There is also need for such an improved apparatus applicable to compressors constructed with machine pressure casings in which the compressor inlet and outlet flow stage pressure boundaries are separated radially by a structural member.

SUMMARY OF THE INVENTION

It is a major object of the invention to provide a recirculation or feedback flow loop, contained within the compressor casing, and characterized by a series of passages through the diffuser bracket from the compressor discharge section back to the inlet section and a mechanism for controlling the flow through them.

It is another object to provide for an arrangement of these passages, that can be varied to enhance compressor performance. Adjusting the number, spacing, crossectional area, shape, and angular orientation of these ports to suit individual applications allows the introduction of favorable pre-swirl to the inlet compressor flow. This pre-swirl has the effect of reducing the inlet velocity of the process gas relative to the compressor impeller.

It is yet another object to provide a system that includes a) a casing having an interior, b) an impeller rotating within said interior between a fluid supply zone and pressurized fluid discharge zone, c) fluid flow control members at least one of which is shiftable in the casing interior relative to the other to control fluid back-flow from said discharge zone to said supply zone via through ports in each of said members, d) and an actuator operatively connected to said one member to shift said one member relative to the other to control the degree of registration of said flow ports in said members, in response to changes in the supply of fluid to said supply zone.

Another object is to provide the members to be relatively rotatable about an axis, and said ports in each member are spaced about said axis. As will be seen, the members preferably extend annularly about that axis, whereby backflow streams through the ports are directed in the supply flow direction, into the impeller inlet streams. In this regard, the ports in at least one member may be elongated in directions substantially parallel to the axis but may also be round; and ports in both members are preferably elongated parallel to that axis for flow control toward the impeller inlet but may also be round and oriented at any angle. Also, ports in each member are preferably spaced at substantially equal intervals about said axis, but may also be spaced at unequal intervals.

An additional object is to locate the impeller entrance to face the supply flow zone and to face toward the incoming backflow streams.

A further object is to provide the casing to include inlet and outlet tubular sections which are interconnected, there being internal structure which is retained in position by the casing inlet and outlet tubular sections, one of said flow control members carried by such internal structure, there being a diffuser at said discharge zone.

A yet further object is to locate the discharge zone from the impeller about the central axis, and also about the registrable ports in the members.

These and other objects and advantages of the invention, as well as the details of an illustrative embodiment, will be more fully understood from the following specification and drawings, in which:

DRAWING DESCRIPTION

DETAILED DESCRIPTION

Figure 1:
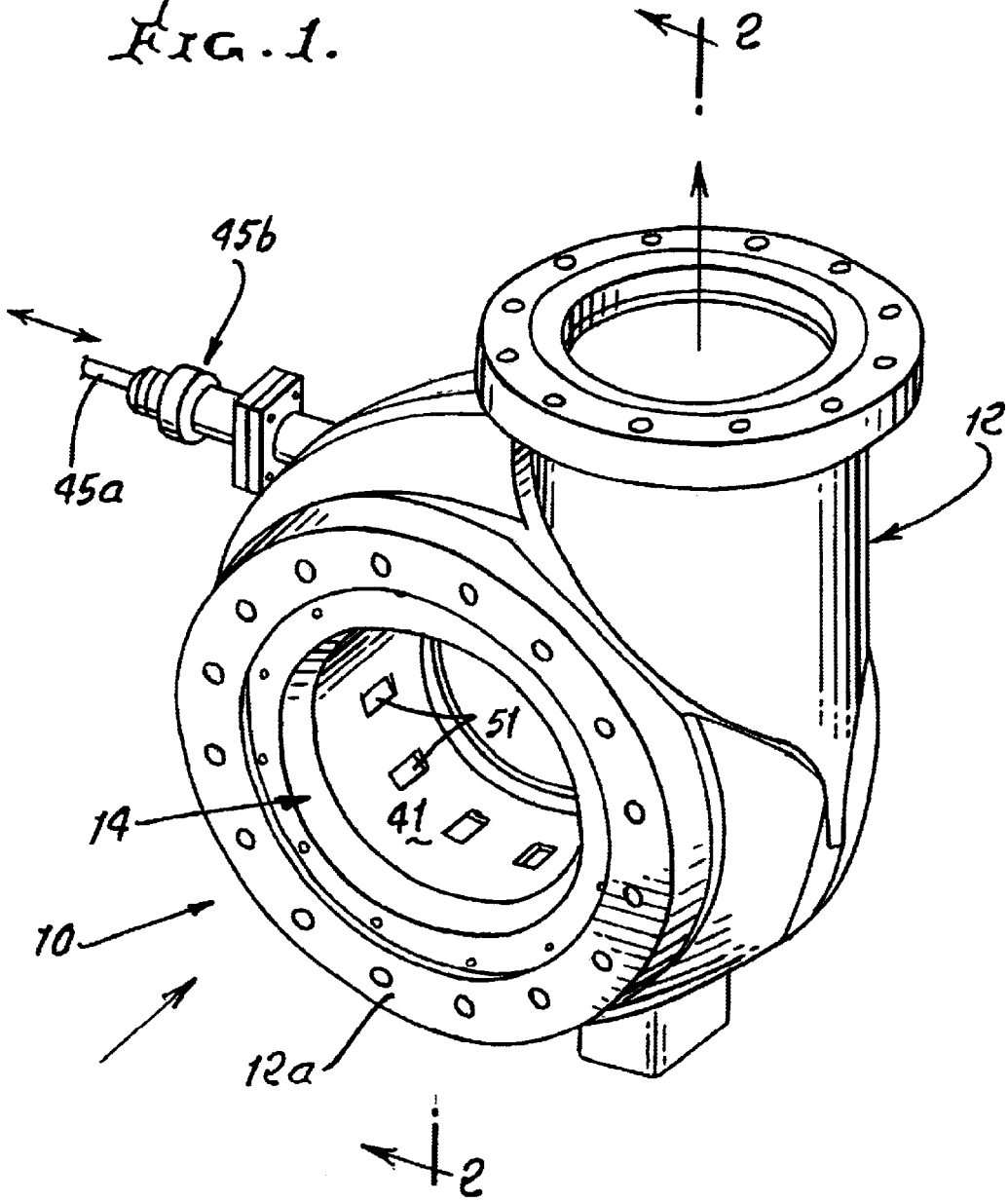
FIG. 1 is a perspective view showing apparatus incorporating the invention.
Figure 2:
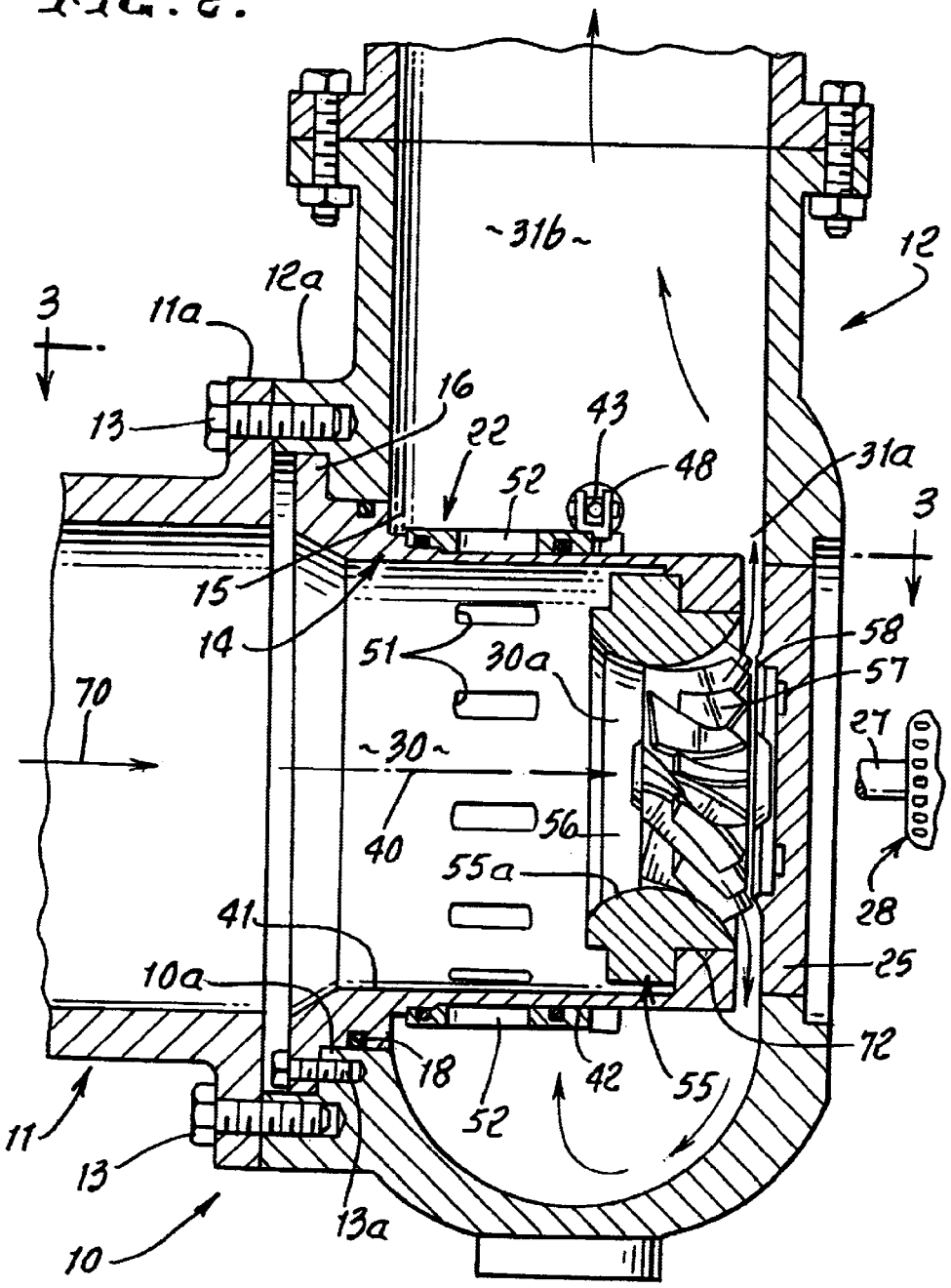
FIG. 2 is a vertical section taken on lines 2—2 of FIG. 1, and showing interior preferred construction.
Figure 3:
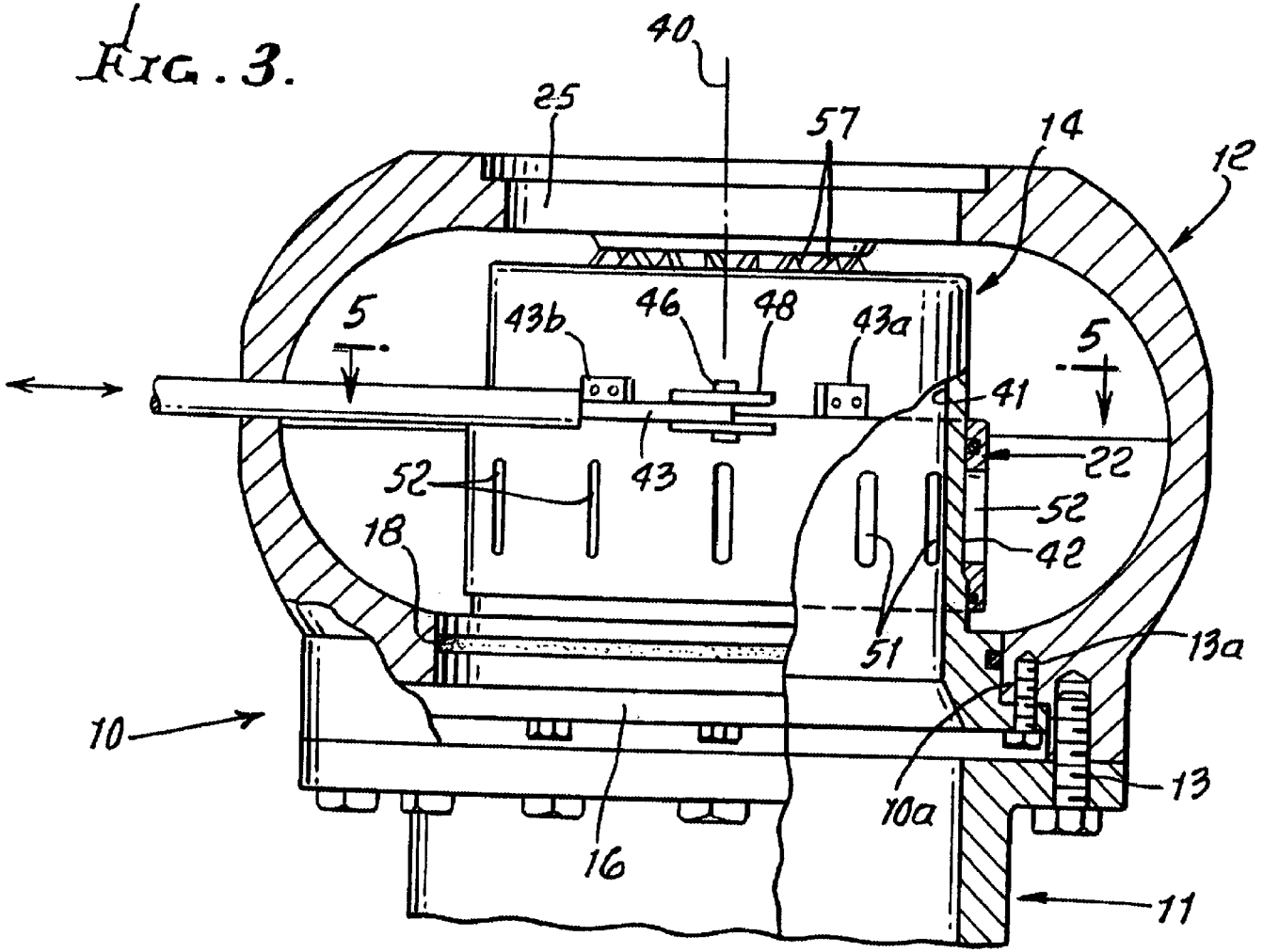
FIG. 3 is a plan view taken in section on lines 3—3 of FIG. 2.

In. FIGS. 1 and 2, the compressor 10 has a casing comprising inlet tubular section 11, outlet tubular section 12, and which are interconnected, as for example by fasteners 13 joining flanges 11*a* and 12*a*. Internal support structure 14 is retained in position in the interior 15 defined by 11 and 12. Structure 14 may include an annular flange 16 and is sealed at 18. Flange 16 is preferentially bolted directly to the casing at 10*a* by 13*a* bolts. An impeller drive shaft 27 may extend through shaft seal plate 25; and a non-specific type driver is indicated at 28. Fluid supply zones are indicated at 30, and 30*a* upstream of the impeller, and a fluid discharge zone or zones is seen at 31*a* and 31*b*, downstream of the impeller. Zones 31*a* and 31*b* are typically annular for back-flow supply to annularly spaced ports in 14 and 22.

Figure 4:
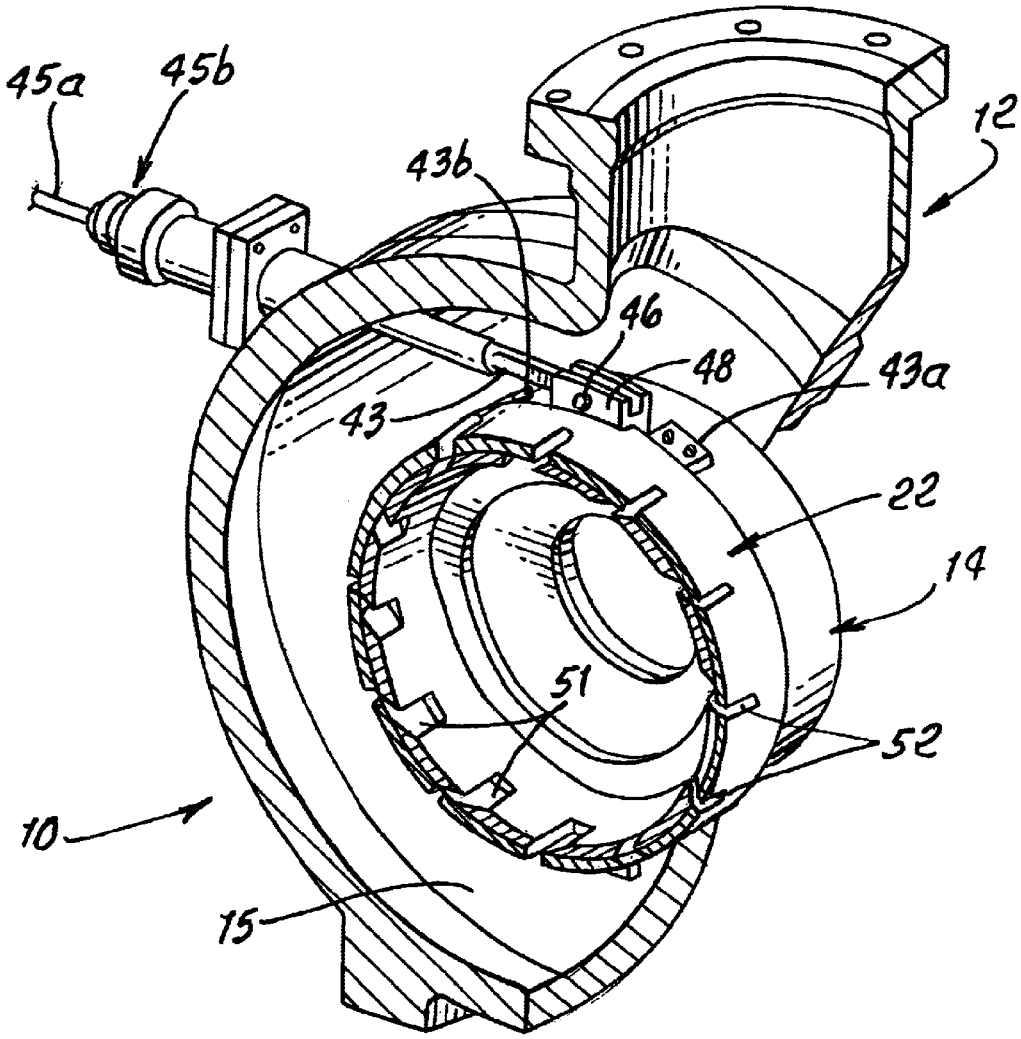
FIG. 4 is a cut-away upright perspective view showing interior construction.

In accordance with important aspects of the invention, fluid flow control members 14 and 22 are configured such that at least one of them is shiftable relative to the other to control fluid back-flow or recirculation from zone 31*b* to zone 30, via through ports in each of the members; and an actuator is operatively connected to one of such members to shift it relative to the other, to control the degree of registration of such flow ports in the members, in response to changes in the supply of fluid to the supply zone 30. In the example, recirculation flow control member 14 is annular to extend about impeller axis 40. Member 14 typically has a cylindrical bore 41 and a cylindrical outer surface 42. It carries the fluid flow control member 22 that is controllably shiftable, as for example rotatable on surface 42 about axis 40, and relative to member 14, in response to lengthwise displacement of actuator rod 43. See FIG. 4 showing a mounting provision for a pneumatic (or other type) of actuator outside the compressor casing.

Figure 7:
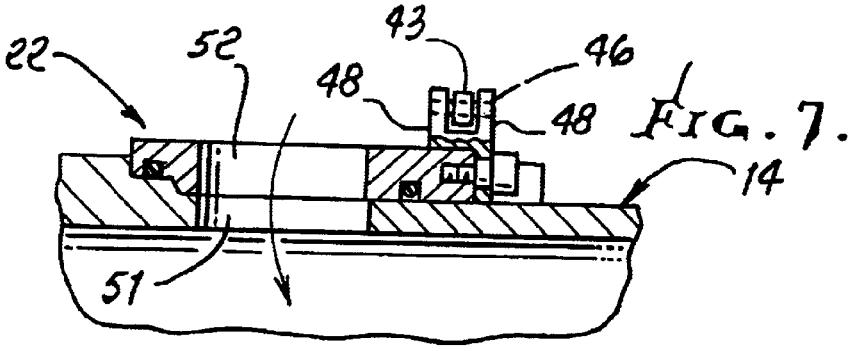
FIG. 7 is an enlarged fragmentary section taken on lines 7—7 of FIG. 6.

The actuator is connected to the actuator rod 43 at 45*a*, the actuator rod 43 being connected by pin 46 to drive boss 48 carried by rotary member 22 and moveable within the casing interior. See also FIG. 7. The actuator rod passes through a gland seal at 45*b*. Stops to limit boss 48 travel are shown at 43*a* and 43*b* to be engageable by one of the faces of 48. Alternate methods of limiting the travel distance of rod 43 may be employed.

In operation, reduction of fluid flow at zone 30*a* is sensed, which causes the surge controller to transmit a signal to the actuator, which effects rotation of 22 in a direction and to an extent tending to restore the desired flow at 30*a*, by changing the recirculation or back-flow of fluid from 31*b* to zone 30, for compression by the impeller.

Fluid flow-through ports are provided at 51 in member 14, and at 52 in member 22, and are adapted to be controllably registered by rotation of 22 to increase or decrease fluid (for example gas) recirculation. Ports 51 are spaced at angular intervals equally, or otherwise, about axis 40, and ports 52 are also spaced at angular intervals equally, or otherwise, about axis 40, and such angular intervals in 14 may equal those in 22 or not. The ports 51 and 52 may be circular or elongated as shown, in directions parallel to axis 40 or at an angle to it, whereby fluid passing through registered openings formed by overlapping extents of the ports is directed to influence the flow field at 30*a* entering the compressor impeller, affecting efficiency and flow stability.

A convex ring shaped inducer surface 55*a* on inducer 55 directs such recirculation inflow as well as supply fluid flow, 70, toward the impeller inlet 56, for compression by rotating blades 57, the flow discharging at 58 from the regions between the blade tips. Inducer 55 is carried at 72 by the fixed member 14.

Figure 5:
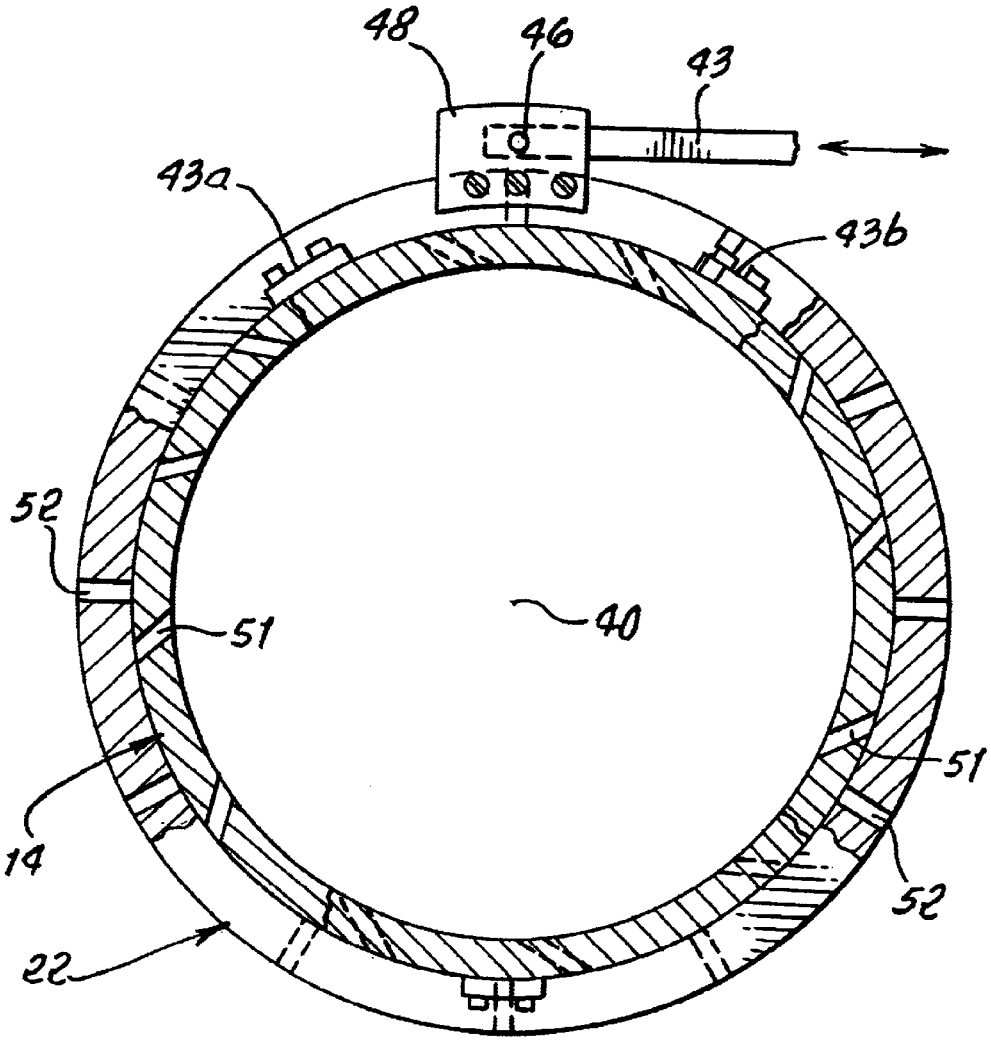
FIG. 5 is a vertical section taken through flow control members, and in a plane normal to the member axis.
Figure 6:
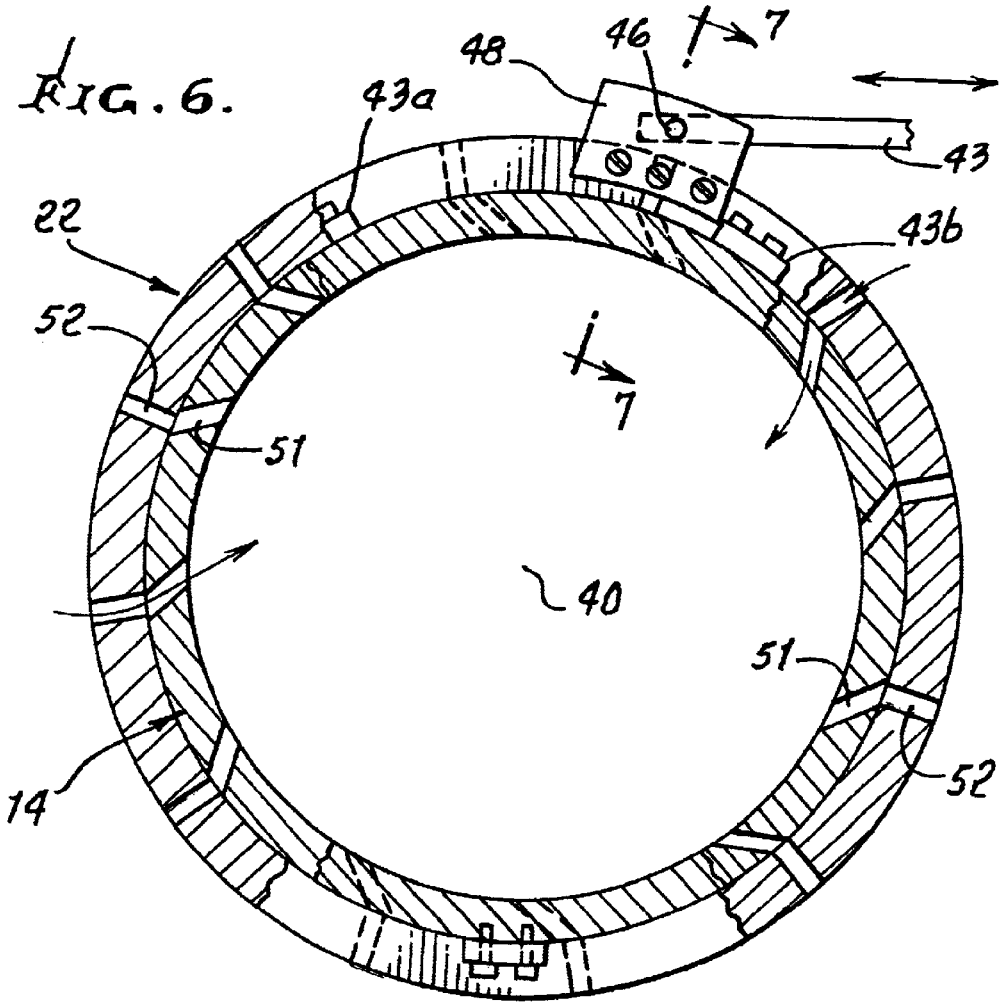
FIG. 6 is a view like FIG. 5, and showing member positions after controlled rotation of one member about the axis.

FIG. 5 shows that ports 51 are angled relative to radii from axis 40 extending to those ports, whereby recirculated flow has tangential or other components, tending to produce inward swirl of the recirculated flow, and in direction of impeller rotation, or otherwise further enhancing efficiency.

In operation, upon a sensed predetermined reduction in flow at region or zone 30*a*, the actuator rotates outer annular flow control member 22 relatively about inner member 14, to increase the registration of ports 51 and 52, thereby to allow more recirculation from higher pressure discharge region 31*b* to lower pressure inlet region 30, enhancing the mass flow of fluid through the impeller, to maintain its flow stability even though the supply flow at 70 to the compressor inlet is reduced.

Further, the provision of the above described system of surge control gives a compressor manufacturer the ability to offer the promise of overall lower costs to plant constructors by eliminating the expenses associated with external surge control piping. This is particularly important for installations on off shore platform sites and other locations where space and weight reductions command a premium. To the end-user, this system offers the promise of compressor function over a wide operating range with minimal mass flow lost to recirculation for surge control and mechanical simplicity for reliability and easy maintenance.

I claim:

1. Apparatus for compressing fluid flow and for controlling said flow, comprising in combination:

a) a casing having an interior, b) an impeller rotating within said interior between a fluid supply zone and pressurized fluid discharge zone, c) fluid flow control members at least one of which is shiftable in the casing interior relative to the other to control fluid back-flow from said discharge zone to said supply zone via through ports in each of said members, d) and an actuator operatively connected to said one member to shift said one member relative to the other to control the degree of registration of said flow ports in said members, in response to changes in the supply of fluid to said supply zone.

2. The combination of claim 1 wherein said members are relatively rotatable about an axis, and said ports in each member are spaced about said axis.

3. The combination of claim 2 wherein said members extend annularly about said axis.

4. The combination of claim 3 wherein said impeller has an entrance facing said supply zone, said axis extending toward said entrance whereby that entrance also faces incoming back-flow streams.

5. The combination of claim 4 wherein said ports in at least one member are elongated in directions substantially parallel to said axis, at an angle to said axis or ports that are round.

6. The combination of claim 4 wherein said ports in each of the members are elongated in direction substantially parallel to said axis, at an angle to said axis or round, whereby back-flow streams through ports in at least partial registration are ducted to add to the impeller inlet flow steam.

7. The combination of claim 6 wherein said ports in each members are spaced at substantially equal intervals about said axis, or any other spacing dictated by design requirements.

8. The combination of claim 3 wherein said members extend about said supply zone.

9. The combination of claim 8 wherein said one member is a sleeve extending annularly about said other members.

10. The combination of claim 3 wherein said one member is a sleeve extending annularly about said other members.

11. The combination of claim 2 wherein the ports in at least one member are angled relative to radii from said axis to produce swirl of the flow through said ports, in a direction about said axis.

12. The combination of claim 1 wherein the casing includes inlet and outlet tubular sections which are interconnected, there being internal structure which is retained in position by the casing inlet and outlet tubular sections, one of said members carried by said internal structure, there being a diffuser at said discharge zone, said diffuser positioned by said one member.

13. The combination of claim 12 wherein said members are annular, said one member being non-rotatable, and the other of said members comprising a sleeve adjustably rotatable about said one member.

14. The combination of claim 13 wherein said discharge zone communicates directly and radially through said ports with said supply zone, said ports in each member spaced at intervals about said axis.

15. The combination of claim 14 wherein said ports in the member closest to said axis being elongated in direction generally parallel to said axis to direct back-flow into the impeller inlet stream.

16. The combination of claim 14 wherein said ports in the member closest to said axis are configured to extend in a direction generally parallel to or at an angle to said axis, to direct back flow into the impeller inlet stream.

* * * * *